US005139069A

United States Patent [19]

Hong

[11] Patent Number: 5,139,069

[45] Date of Patent: Aug. 18, 1992

[54] LIGHT PROOF PLEATED WINDOW SHADE

[76] Inventor: Amy Hong, No. 9, Jenn-Shing Lane, Fu-Nan Village, Fu-Shing Hsiang, Changhua Shiann, Taiwan

[21] Appl. No.: 729,103

[22] Filed: Jul. 12, 1991

[51] Int. Cl.[5] ..... A47H 5/00

[52] U.S. Cl. ..... 160/84.1; 160/237

[58] Field of Search ..... 160/84.1, 237, 123, 160/330, 340, DIG. 7

[56] References Cited

U.S. PATENT DOCUMENTS

| | | | |
|---|---|---|---|
| 2,295,137 | 9/1942 | Sutton | 160/84.1 |
| 3,478,805 | 11/1969 | Haggard | 160/84.1 X |
| 3,952,788 | 4/1976 | Scholer | 160/84.1 |
| 3,999,590 | 12/1976 | Koch | 160/84.1 |
| 4,907,635 | 3/1990 | Bunger et al. | 160/84.1 |

FOREIGN PATENT DOCUMENTS

| | | | |
|---|---|---|---|
| 8800535 | 10/1989 | Netherlands | 160/84.1 |
| 1436957 | 5/1976 | United Kingdom | 160/84.1 |
| 2189135 | 10/1987 | United Kingdom | 160/84.1 |

*Primary Examiner*—David M. Purol
*Attorney, Agent, or Firm*—Browdy and Neimark

[57] ABSTRACT

A light proof pleated window shade comprises an upper rail, a bottom rail, a pleated blind arranged between the upper rail and the bottom rail, a string set with one end thereof being fastened securely to the bottom rail and with the other end thereof passing through a plurality of string loops attached integrally to the pleated blind and through the upper rail, and a string pulley lock arranged in the end portion of the upper rail to permit the free end of the string to emerge therefrom and to retain the string. The pleated blind is characterized in that it comprises thereto a plurality of loop areas of a width located at the protruded edges of folded portions thereof. The loop areas are composed of the woof thread and the warp thread which are not interlaced. The woof thread of loop area extends outwardly to form a string loop to accommodate therein a string.

2 Claims, 2 Drawing Sheets

LIGHT PROOF PLEATED WINDOW SHADE

BACKGROUND OF THE INVENTION

The present invention relates to a window shade, and more particularly to an innovative structure of a light proof pleated window shade.

As shown in FIG. 1, a conventional pleated window shade 10 of prior art comprises a pleated blind 13 arranged between the upper rail 11 and the bottom rail 12. The pleated blind 13 is composed of a plurality of pleated portions, with each of pleated portions having a string hole 14 punched through both sides thereof for the purpose of accommodating therethrough a string 15. The string holes 14 are positioned in alignment. The upper rail 11 comprises a string pulley lock 16 located at the end portion thereof for controlling and restraining the movement of the string 15. The time-honored pleated window shade 10 described above is inherently defective in design in that its string holes 14 permit the light to pass through and can be used improperly as peep holes.

In order to overcome the problems mentioned above, the pleated window shade 20, as shown in FIG. 2, was introduced as exemplified in PCT WO 88/07345 in which the blind 21 of Y-shaped construction comprises the string holes 23 bring punched through the shoulders 22 thereof of a predetermined width extending outwardly in the same directed from the Y-shaped pleated portions of the blind 21. There is no doubt that the pleated window shade 20 as such can overcome the foregoing problems effectively. However, the pleated window shade 20 of prior art is disadvantageous in that it has never been produced in quantity economically and has been therefore marketed only on a trial basis, without the benefit of an enthusiastic reception by the consumers at large.

Another category of prior art structures is described by this inventor in the U.S. Pat. No. 5,054,534, in which this inventor discloses a pleated window shade comprising dual blinds. Needless to say, the cost of producing a pleated window shade with dual blinds, as proposed by this inventor, is inherently higher than that of producing a similar pleated window shade having a single blind. Therefore, an effort to improve the pleated window shade having dual blinds is called for.

SUMMARY OF THE INVENTION

It is therefore the primary objective of the present invention to provide a pleated window shade which is superior to any pleated window shade available at the market place today and is capable of reducing the cost of production thereof.

In keeping with principles of the present invention, the primary objective of the present invention is accomplished by a pleated window shade comprising thereto a plurality of integral string loops located in a coplanar manner at the protruded edges of the folded portions thereof for accommodating therein a string. The string loops are constructed at predetermined positions of the fabric, intended for use in making the pleated window shade of the present invention, by means of adjusting the loom to permit the woof thread to skip from being interlaced by the warp thread to form a loop area during the weaving process. Therefore, it is not necessary to punch holes in the pleated window shade to receive the string, resulting in a perfect lightproof effect of the pleated window shade.

However, it is possible that the loop areas of the fabric may not be positioned exactly at the protruded edges of the folded portions, as required, when the fabric is used to make a pleated window shade. In order to overcome this problems, this inventor proposes a workable and practical solution, which is expounded hereinafter.

The fabric intended to be used in making a pleated window shade of the present invention is made to comprise a predetermined number of loop areas of predetermined width located at predetermined positions thereof. This fabric is weaved in a manner that the woof thread thereof located at the loop area is not interlaced by the warp thread thereof located at the loop area. As a result, when the fabric containing loop areas is folded latitudinally into a plurality of folded portions, there will always be a loop area, which is formed by the woof thread and is located at the protruded edge of the folded portion. The loop area can be pulled slightly apart from the fabric to which it is attached, and the pulled loop area is then formed into a string loop which is used to receive a string.

The advantages of the pleated window shade embodied in the present invention over the pleated window shades of prior art have become readily apparent. The pleated window shade of the present invention uses only a single blind rather than dual blinds and is therefore more provident in terms of amount of fabric used. In addition, the pleated window shade of the present invention is devoid of string holes and is therefore more economical in terms of the extent of labor involved.

Furthermore, an appropriate pasty mixture can be applied to the pleated window shade of the present invention to make it appropriately rigid and to fill in any possible weaving gap remaining in the fabric so as to keep the light out effectively. In order to permit the pleated window shade of the present invention to fold together compactly, the fabric used can be coated thereon with a layer of plastic material or metal. The pleated window shade of the present invention is therefore capable of keeping the light out effectively even though the woof thread is not interlaced with the warp thread at the places where the loop areas are located.

DETAILED DESCRIPTION OF THE PREFERRED EMBODIMENT

Figure 1:
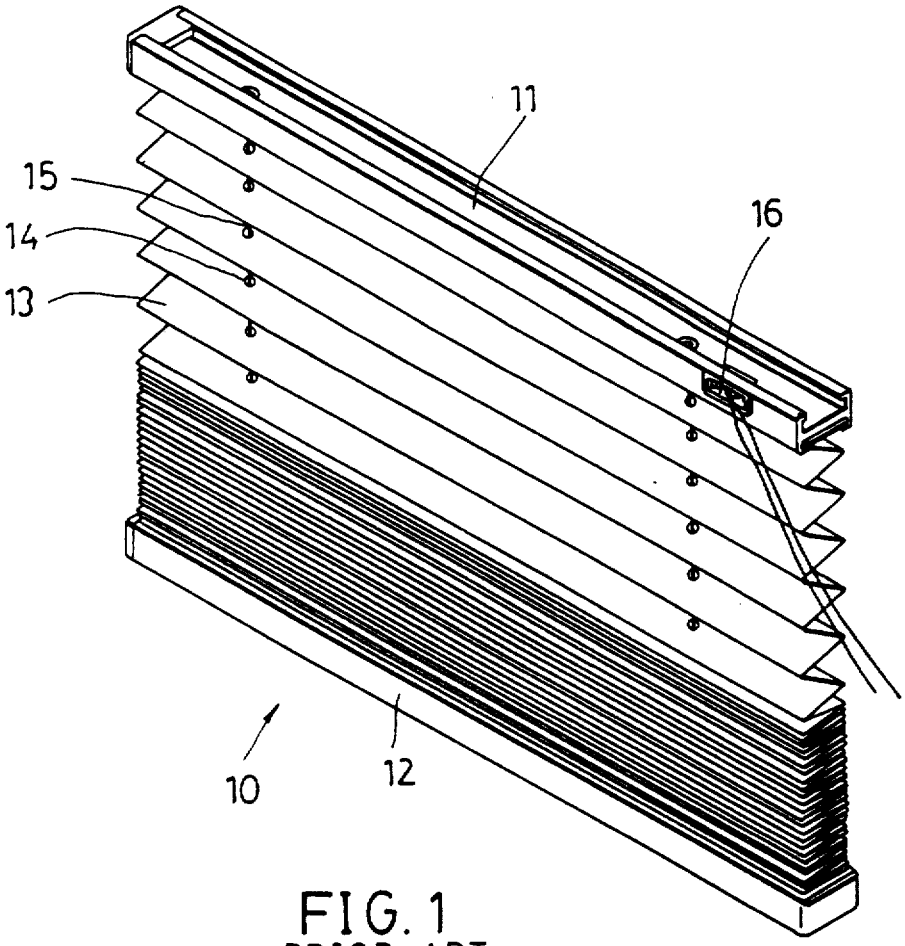
FIG. 1 PRIOR ART
FIG. 1 shows an external three-dimensional view of a pleated window shade of prior art.
Figure 2:
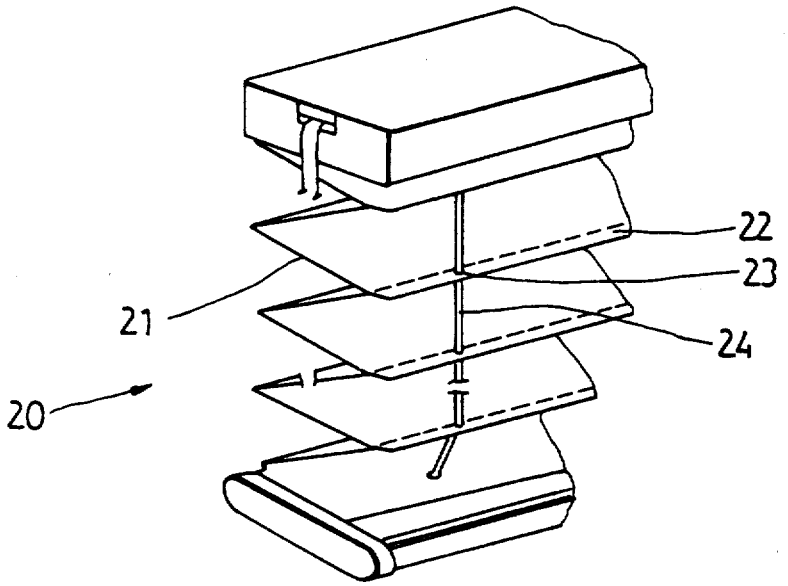
FIG. 2 PRIOR ART
FIG. 2 shows an external three-dimensional view of portion of a light proof pleated window shade of the prior art.
Figure 3:
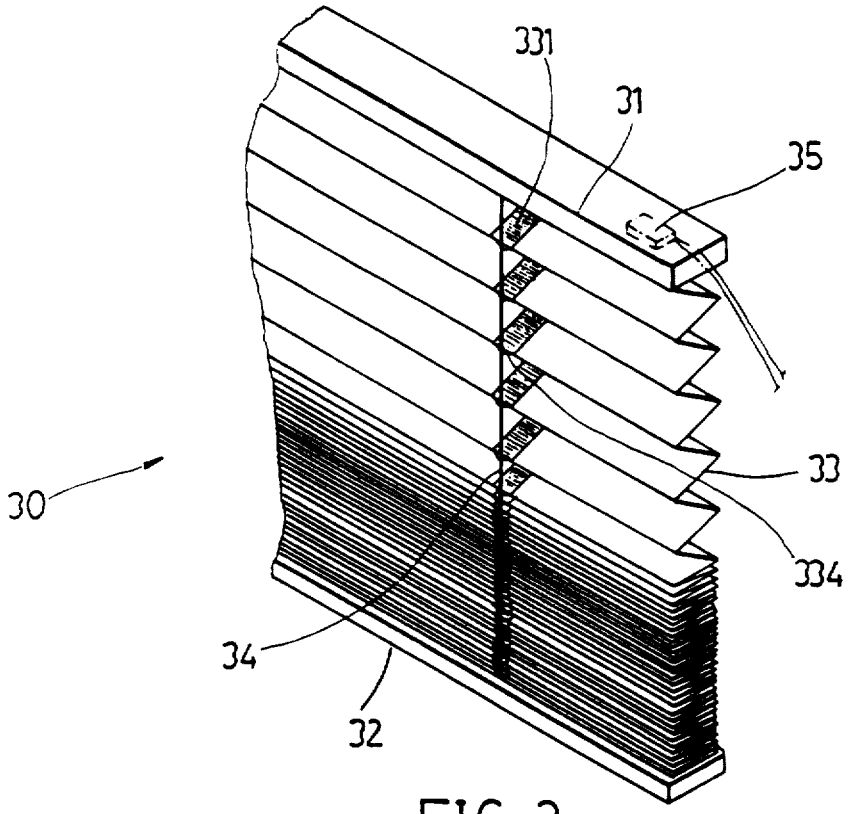
FIG. 3 shows an external three-dimensional view of a pleated window shade of the present invention.
Figure 6:
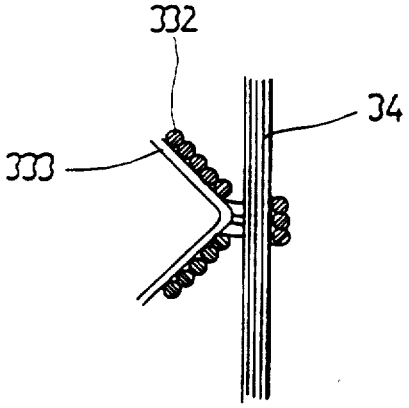
FIG. 6 shows an enlarged schematic view of a longitudinal section of the portion, where the string is received, according to the present invention.
Figure 4:
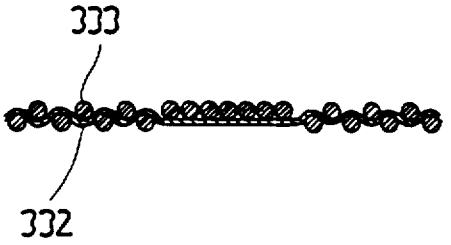
FIG. 4 shows an enlarged schematic view of a cross section of the fabric used to make a pleated window shade of the present invention.
Figure 5:
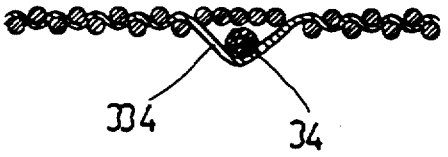
FIG. 5 shows an enlarged schematic view of a cross section of the portion, where the string is received, according to the present invention.

Referring to all drawings provided, a light proof pleated window shade 30 embodied in the present invention is shown comprising mainly an upper rail 31, a bottom rail 32, and a pleated blind 33 arranged between the upper rail 31 and the bottom rail 32. The pleated blind 33 comprises loop areas 331 of the predetermined width, where the woof thread 332 is not interlaced by the warp thread 333. The pleated blind 33 is folded latitudinally at an equal interval to comprise a plurality of continuously pleated portions. Each of the pleated portions is composed of two loop areas 331 located at the protruded edges thereof in a coplanar manner. The woof thread 332 of the loop area 331 is extended outwardly to form a string loop 334, which serves to accommodate therein a string 34. One end of the string 34 is attached securely to the bottom rail 32 while the other free end of the string 34 passes through the upper rail 31 to emerge therefrom at the string pulley lock 35 arranged in the end portion of the upper rail 31. The string pulley lock 35 is used to retain the string 34 so that the pleated window shade 30 can be easily pulled up or down at will.

The embodiment of the present invention described above is to be considered in all respects as merely an illustration of principles of the present invention. Accordingly, the present invention is to be limited only by the scope of the hereinafter appended claim.

What I claim is:

1. A light-proof woven pleated blind for use in producing a window shade having an upper rail, a bottom rail, said light-proof woven pleated blind arranged between said upper rail and said bottom rail, one end of a string being fastened securely to said bottom rail and a second free end of said string passing through said pleated blind and said upper rail, a string pulley lock arranged in an end portion of said upper rail to permit said second free end of said string to emerge therefrom and retain said string, said light-proof woven pleated blind comprising woof threads, warp threads, a plurality of woof threads alternately woven to a plurality of said warp threads to form said woven pleated blind, a plurality of loop areas produced by a selected area of consecutive said woof threads lying over a side of a selected area of consecutive said warp threads, whereby said plurality of loop areas can receive said second free end of said string between said selected area of consecutive said woof threads and said selected area of consecutive said warp threads.

2. The light-proof woven pleated blind of claim 1 wherein said plurality of said woof threads alternatively woven to said plurality of said warp threads are coated with a pasty mixture to keep light out.

* * * * *